United States Patent [19]

Bryson

[11] Patent Number: 4,643,242

[45] Date of Patent: Feb. 17, 1987

[54] DEVICE FOR COLLECTING MOLTEN METAL BREAK-OUTS IN CASTING OF LIGHT METALS

[75] Inventor: Neil B. Bryson, Kingston, Canada

[73] Assignee: Alcan International Limited, Montreal, Canada

[21] Appl. No.: 802,837

[22] Filed: Nov. 27, 1985

[30] Foreign Application Priority Data

Nov. 30, 1984 [CA] Canada ..... 469060

[51] Int. Cl.[4] ..... B22D 11/00

[52] U.S. Cl. ..... 164/153; 164/418; 164/459; 164/487

[58] Field of Search ..... 164/485–487, 164/459, 418, 152, 153, 491, 436

[56] References Cited

U.S. PATENT DOCUMENTS 3,860,061 1/1975 Hoyer ..... 164/153

FOREIGN PATENT DOCUMENTS 2431888 3/1980 France ..... 164/418

*Primary Examiner*—Kuang Y. Lin

*Attorney, Agent, or Firm*—Copper, Dunham, Griffin & Moran

[57] ABSTRACT

A device is described for collecting molten metal break-outs which may occur during direct chill casting of light metal, e.g. aluminum or aluminum alloy ingots. The device includes a water-cooled mould of the cross sectional shape of the ingot desired, this mould having a vertically moveable base portion to support the ingot formed and being disposed above a pit for receiving the resultant casting and means for applying water onto the freshly solidified surface of the ingot as it emerges from the mould downwardly into the pit. The novel feature consists of at least one hollow container adjacent the side or sides of the ingot being formed, each container being packed with dry, highly heat-absorptive, finely divided material having a large surface to volume ratio. Each container has an open top positioned a short distance below the mould such as to catch a break-out of molten metal at the exit of the mould.

7 Claims, 3 Drawing Figures

DEVICE FOR COLLECTING MOLTEN METAL BREAK-OUTS IN CASTING OF LIGHT METALS

BACKGROUND OF THE INVENTION

This invention relates to the casting of light metals, such as aluminum and alloys thereof.

Light metals, such as aluminum and alloys thereof, are usually cast in the form of ingots which are then further worked, for example by rolling or extrusion. Such ingots are typically produced by the vertical, direct chill (DC) method.

It has been standard practice for many years to mount the metal melting furnace slightly above ground level with the casting mould at, or near to, ground level. The cast ingot is then lowered into a pit as the casting operation proceeds. Cooling water, after being applied as direct chill, flows into the pit and is continuously removed therefrom while leaving a permanent pool of some water within the pit.

During the direct chill casting of aluminum and its alloys, violent explosions may occur if the molten metal and the water used as a coolant in the process come into mutual contact under certain conditions. Recently it has been found that the explosive violence is greatly increased if the alloying element is lithium.

The mutual contact between the molten metal and water is usually the result of "run outs" which occur in which molten metal escapes in a break out from the sides of the ingot emerging from the mould. Much experimental work has been carried out over the years to establish the safest possible conditions for direct chill casting of aluminum. A well known paper on the subject is that of George Long in "Metal Progress" May 1957 pages 107–112. One of the solutions proposed in that report was to maintain a substantial depth of water within the pit.

It is the object of the present invention to provide a system which will rapidly quench molten metal break outs while direct chill casting, without contact between the molten metal from the break-out and wet surfaces.

SUMMARY OF THE INVENTION

Thus, the present invention in its broadest aspect relates to an apparatus for the vertical continuous direct chill casting of light metal ingots, comprising a water-cooled mould of the cross sectional shape of the ingot desired, this mould having a vertically moveable base portion to support the ingot formed and being disposed above a pit for receiving the resultant casting and means for applying water onto the freshly solidified surface of the ingot as it emerges from the mould downwardly into the pit. This apparatus is characterised by the presence of at least one hollow container adjacent the side or sides of the ingot being formed, each container being packed with dry, highly heat-absorptive, finely divided material having a large surface to volume ratio. Each container has an open top positioned a short distance below the mould such as to catch a break-out of molten metal at the exit of the mould.

A typical ingot formed has four sides and four hollow containers are positioned adjacent the four sides of the ingot with the tops of the hollow containers being located a short distance below the mould. The ingot may, of course, have other shapes, e.g. round, in which case the hollow containers preferably have the shape of annular segments.

A variety of different materials may be used as packing for the containers. Generally, the material used should have the following characteristics:

1. High specific heat;
2. High latent heat of melting;
3. Non-reactive to molten Al-Li alloys;
4. Does not emit toxic gases on rapid heating/melting;
5. Can be comminuted readily to give high surface/volume ratio;
6. Melting temperature no greater than that of alloy being cast;
7. Non-hygroscopic.

It is particularly preferred to use a dry aluminous material, e.g. in the forms of machine turnings, fine wire, etc. The containers are preferably filled to an apparent density of 25 to 50% that of solid aluminum. When a break-out occurs, the molten metal runs into one of the above containers. As the molten stream passes through the aluminous material in the container, it is broken up and its heat content is very rapidly removed by the melting of some of the aluminum packing. The molten metal stream solidifies before reaching the bottom of the container. As soon as the molten stream from the break-out has been stopped, the container with the solidified break-out can safely be removed from the casting pit and the packing replaced for further use.

The top of each container is normally covered with a layer of thin aluminum foil to prevent any extraneous water from accidently entering the container. This cover melts almost instantaneously upon being struck by the falling stream of molten metal during a break-out.

BRIEF DESCRIPTION OF THE DRAWINGS

In the drawings which illustrate the present invention.

DETAILED DESCRIPTION

Figure 1:
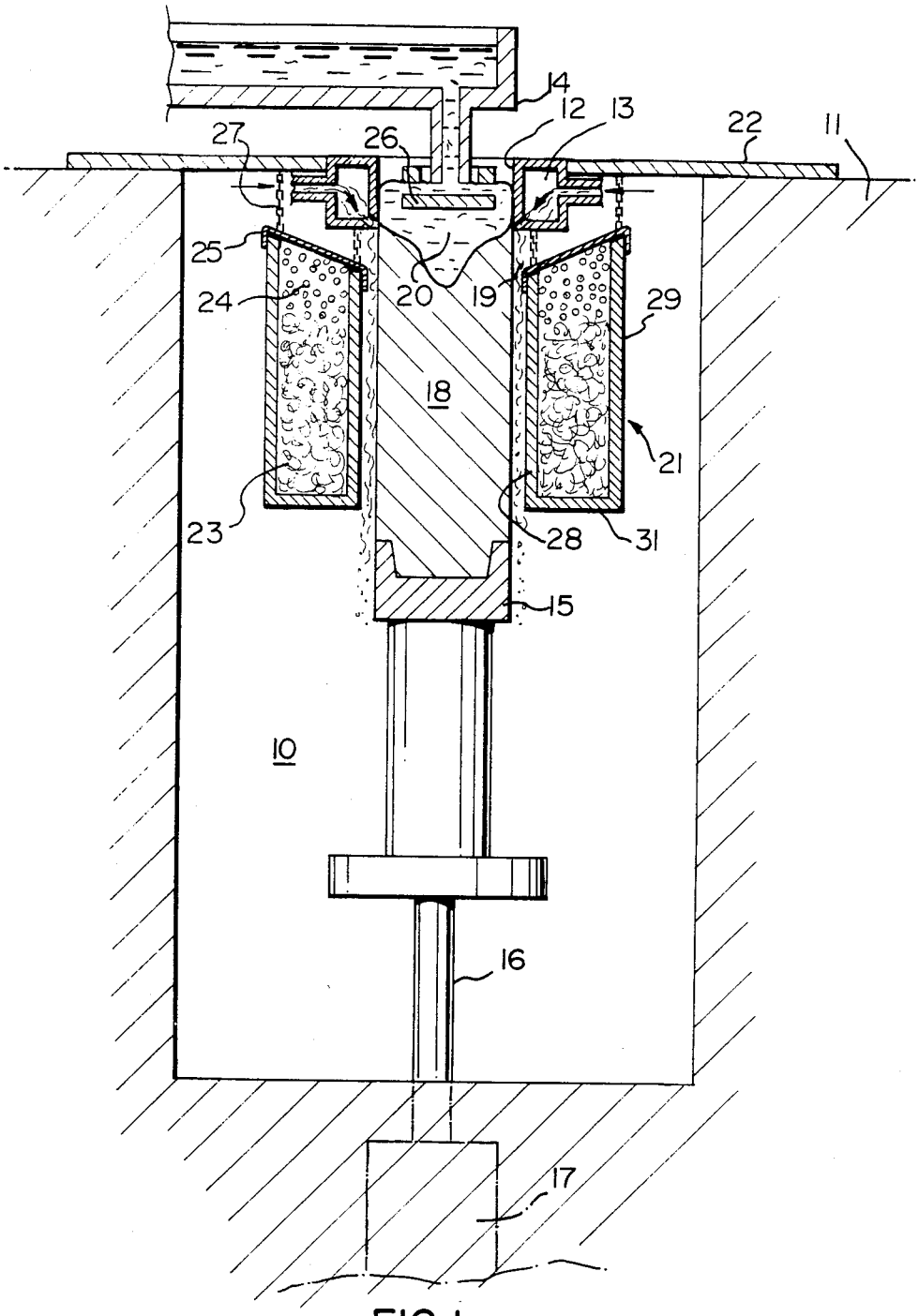
FIG. 1 is a sectional view diagramatically showing a casting pit utilizing the present invention.

A typical direct casting operation is shown in FIG. 1 with a casting pit 10 extending down below ground level 11. A mould 12 is positioned at ground level and adjacent the mould is a water box 13 through which quench water passes.

Positioned above the mould 12 is a molten metal transfer trough 14. This feeds molten metal into the mould 12 over baffle 26.

Within the pit 10 is a bottom block 15 supported by an hydraulic ram 16 operated from a drive mechanism 17 in the bottom of the pit 10. The bottom block 15 supports the ingot 18 being formed.

It can be seen from FIG. 1 that the molten metal 20 in the form of a liquid sump within the mould quickly solidifies around the edges, assisted by the quench water 19 flowing out of water box 13 and down along the periphery of the ingot.

The feature of the present invention is the installation of the open top containers 21 around the ingot being formed. The containers are preferably supported from support members 22 by chains 27 and are usually positioned approximately 12 inches below the mould, while leaving a clearance of approximately of 1 inch for the free passage of the water-covered ingot.

The top of each container 21 is preferably covered by a thin aluminum foil cover 25. Within each container is placed a packing of dry, finely divided aluminous material 23 and above this packing is preferably placed a layer of ceramic balls 24 to disperse and break up the molten stream.

Figure 2:
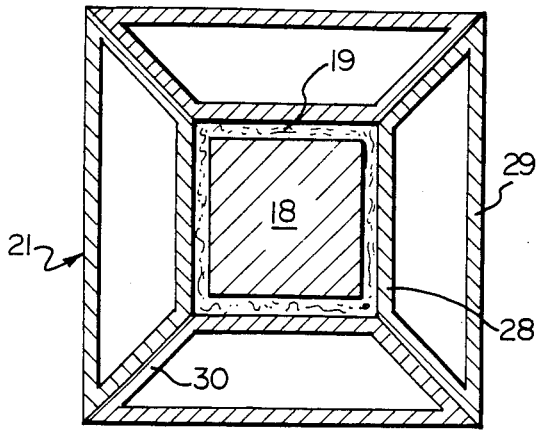
FIG. 2 is a top plan view of the containers of the invention.

The containers 21 are shaped and positioned to fully protect the area surrounding the ingot below the mould. Four containers 21 are shown in FIG. 2 surrounding a square ingot 18. Each container has four sides, with an inner wall 28, an outer wall 29, side walls 30 and a bottom 31. The inner wall 28 is lower than the outer wall 29, providing an inclined top portion. The container walls are preferably made of aluminum.

Figure 3:
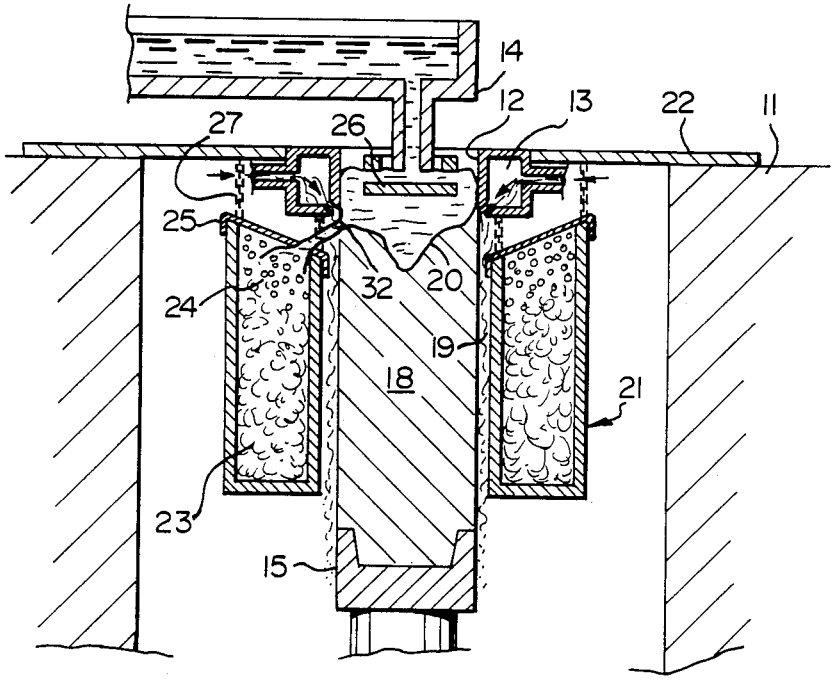
FIG. 3 is a sectional view diagramatically showing a break-out.

The danger area in this casting system is the rather thin solidified wall portion immediately below the mould 12. If a break-out occurs, it usually occurs at this location. Such a break-out is illustrated in FIG. 3. However, with the containers 21 in position, the break-out 32 almost instantaneously melts the aluminum foil cover 25 and the flow of molten metal is collected by the container. The volume of each container 21 should not be less than twice the volume of the liquid metal contained in the liquid sump 20 of the ingot 18.

While this invention has been described in specific detail with particular reference to a preferred embodiment thereof, it will be understood that variations and modifications can be affected within the spirit and scope of the invention as described hereinbefore and as defined in the appended claims.

I claim:

1. An apparatus for the direct chill casting of light metal ingots comprising a water-cooled mould of the cross-sectional shape of the ingot desired, said mould having a vertically moveable base portion to support the ingot formed and being disposed above a pit for receiving the resultant casting and means for applying water onto the freshly solidified surface of the ingot as it emerges from the mould and moves downwardly into the pit, characterized by at least one hollow container adjacent the side or sides of the ingot being formed, said at least one container being packed with dry, highly heat-absorptive, finely divided material having a large surface to volume ratio and said container having an open top positioned a short distance below the mould such as to catch a break-out of molten metal at the exit of the mould.

2. The apparatus of claim 1 wherein a plurality of hollow containers are placed adjacent corresponding sides of the ingot.

3. The apparatus of claim 1 wherein the open top of the container is covered by a thin aluminum foil.

4. The apparatus of claim 1 wherein the dry, highly heat-absorptive, finely divided material is finely divided aluminous material.

5. The apparatus of claim 4 wherein said at least one hollow container is packed with said aluminous material to an apparent density of 25 to 50% of that of solid aluminum.

6. The apparatus of claim 4 wherein ceramic balls or particles are placed in the hollow container above the dry aluminous material.

7. The apparatus of claim 1, wherein the volume of each hollow container is not less than twice the volume of the liquid metal contained in the liquid sump of the ingot.

* * * * *